US009073225B2

(12) United States Patent
Chen et al.

(10) Patent No.: US 9,073,225 B2
(45) Date of Patent: Jul. 7, 2015

(54) HAIR TRIMMING DEVICE

(71) Applicant: TZENG FONG INDUSTRIAL CORPORATION, New Taipei (TW)

(72) Inventors: Chin-Chuan Chen, New Taipei (TW); Yu-Hsia Yang, New Taipei (TW); Hung-Chieh Chen, New Taipei (TW); Cheng-I Chen, New Taipei (TW); Cheng-Hsiang Chen, New Taipei (TW)

(73) Assignee: Tzeng Fong Industrial Corporation, New Taipei (TW)

( * ) Notice: Subject to any disclaimer, the term of this patent is extended or adjusted under 35 U.S.C. 154(b) by 236 days.

(21) Appl. No.: 13/886,280

(22) Filed: May 3, 2013

(65) Prior Publication Data

US 2014/0325848 A1 Nov. 6, 2014

(51) Int. Cl.

*B26B 13/14* (2006.01)
*B26B 13/08* (2006.01)
*B26B 13/24* (2006.01)

(52) U.S. Cl.

CPC ..... *B26B 13/24* (2013.01)

(58) Field of Classification Search

CPC ..... B26B 13/14; B26B 13/08; A45D 24/10; A45D 24/06; A45D 24/16
USPC ..... 30/233.5, 195, 253, 30, 244, 245, 254, 30/200, 294, 131, 132, 208, 51, 236, 194, 30/234; 7/136; 132/214, 219, 213.1, 120, 132/129, 223, 213
See application file for complete search history.

(56) References Cited

U.S. PATENT DOCUMENTS

| | | | | |
|---|---|---|---|---|
| 5,123,159 | A * | 6/1992 | Kubo et al. | 30/196 |
| 5,237,750 | A * | 8/1993 | Nakano et al. | 30/131 |
| 2010/0252059 | A1* | 10/2010 | Peverini | 132/120 |
| 2011/0302789 | A1* | 12/2011 | Chen et al. | 30/233.5 |
| 2014/0317938 | A1* | 10/2014 | Peverini | 30/208 |

FOREIGN PATENT DOCUMENTS

| | | |
|---|---|---|
| TW | M349832 | 2/2009 |

* cited by examiner

*Primary Examiner* — Ghassem Alie
(74) *Attorney, Agent, or Firm* — Leong C. Lei

(57) ABSTRACT

A hair trimming device has a first knife, a second knife, a first protective cover, a pair of movable plates, an elastic element and a second protective cover. The first protective cover covers the first knife and has a first comb installed at a front end of the first knife, and the pair of movable plates are linked with both external sides of the second knife and the first knife, and the second protective cover is installed at a front end of the pair of movable plates, and a second comb is disposed between the first comb and the cutting blade, such that the movable plate is linked to the second comb. When use, hairs of different lengths are bent and fixed and then cut to achieve layered hair styling without any discomfort caused by tearing the hair.

10 Claims, 11 Drawing Sheets

HAIR TRIMMING DEVICE

BACKGROUND OF THE INVENTION

1. Field of the Invention

The present invention relates to the technical area of barber scissors, and more particularly to a hair trimming device capable of preventing uncomfortable feeling caused by tearing hair during haircut and creating layered hair styling after the hair cut.

2. Description of the Related Art

In general, barber tools such as dedicated scissors, electric barber cutters and sandwich-cut hair trimmers are used by barbers to cut and trim hair according to a hair design.

Since the barber dedicated scissors usually come with exposed sharp blades, special attentions must be taken for the safety of its use and storage. Electric barber cutters adopt an electric motor and alternately operated blades to cut and trim hair quickly, and most electric barber cutters are used for trimming flatheads or massive cuttings, but they usually cannot control the processing details accurately for a quick trimming or cutting, so that most barbers use both of the aforementioned tools for the hair cut. However, the aforementioned two barber tools require the barbers to grab or comb the hair to be cut before the cutting, and the blades of the scissors and electric barber cutters are operated in a lateral clamping method or squeezing the hair in a direction for the cutting, so that the cutting edge usually has an oblique and uneven surface. As a result, the hair ends may have an unsmooth touch or burrs after the hair is cut.

The hair trimmer of this sort is made of a pair of clamping plates and a cutting blade disposed at an edge of each clamping plate, wherein each of the clamping plates has an elastic element, so that when the pair of clamping plates are assembled, the pair of elastic elements are situated opposite to each other to provide the required elasticity. During use, a user's hair is placed between the two cutting blades, and an external force is applied to the pair of clamping plates directly to engage the two cutting blades with each other for shearing the hair. This hair trimmer adopts a two-directional squeezing and cutting method and uses its upper and lower blades to cut the hair in a vertical direction to produce a smooth and even surface of the cutting edge, so that the hair ends have a smooth touch and have no burrs. However, such hair trimmer cannot have a good control on the cutting position, length and layer of the cutting hair and the ends of the cut hair is too tidy and lack of aesthetic look.

Therefore, the inventor of the present invention has filed a patent with the Taiwanese Intellectual Property Office Utility Model No. M349832, entitled a "hair trimmer", and this hair trimmer comprises cutting portions for touching and fixing a user's hair, and comb units for clamping and bending the user's hair. Since the bent hair has a different length, layered hair styling can be achieved, but the operation may pull the user's hair roots and cause discomfort, so that further improvements are required.

SUMMARY OF THE INVENTION

The primary objective of the present invention is to provide a hair trimming device capable of preventing uncomfortable feeling caused by tearing hair in a haircut and creating layered hair styling after the hair cut, wherein a first comb of a first protective cover and a second comb of a second protective cover are adopted, and hairs with different lengths are bent and fixed, and then the hairs are cut to naturally produce layered hair styling of different hair lengths. In addition, the second protective cover is linked to a pair of movable plates, and the movable plates are further linked with a first knife and a second knife, such that when use, the first comb and the second comb clamp and fix the hair before cutting the hair. The operation is very convenient without any discomfort caused by tearing the hair.

To achieve the aforementioned object, the present invention provides a hair trimming device, comprising:

a first knife, having a cutting blade disposed at an end of the first knife, a first pivoting portion disposed at the other end of the first knife, and a prop member and a limit member disposed on both sidewalls of the first knife respectively, and the prop member being protruded outwardly from a plane of the sidewall, and the limit member being disposed adjacent to a side of the first pivoting portion;

a second knife, having a containing slot formed at an end of the second knife and corresponding to the cutting blade, a second pivoting portion disposed at the other end of the second knife and corresponding to the first pivoting portion for pivotally coupling the second knife and the first knife as a whole, and normally maintaining elastically open, and a third pivoting portion, a first limiting hole and a second limiting hole disposed on both sidewalls of the second knife respectively, and the first limiting hole being disposed at a position corresponding to the limit member and movably contained in the limit member, and a protrusion being formed on a side of the second limiting hole;

a first protective cover, covered onto the exterior of the first knife, and having at least one first comb corresponding to the first protective cover, a plurality of first comb teeth formed at an edge of the first comb, and a plurality of first comb grooves with different depths formed between two adjacent first comb teeth respectively;

a pair of movable plates, each having a fourth pivoting portion disposed at the center of the movable plate and corresponding to the third pivoting portion, and the pair of movable plates being respectively, movably and pivotally coupled to the pair of third pivoting portions, and a through hole and a limiting plate being disposed at an end of each movable plate, and an assembling portion being disposed at the other end of each movable plate, wherein the pair of prop members of the first knife propping an upper edge of the pair of corresponding movable plates to define a linkage;

an elastic element, installed between the first knife and the second knife, and having an end passing into the pair of through holes of the pair of movable plates, and the other end fixed onto the second knife, and the resilience of the elastic element being used to push the pair of movable plates upward; and a second protective cover, coupled between the assembling portions of the pair of movable plates, and having at least one second comb corresponding to the containing slot, a plurality of second comb teeth formed at an edge of the second comb, with a plurality of second comb grooves with different depths disposed between any two adjacent second comb teeth respectively.

During use, a handful of hair is placed between the first knife and the second knife, and then the first protective cover and the second knife are operated to produce a closing movement with respect to each other, so that the handful of hair is pushed and squeezed by the cutting blade and uniformly spread into the containing slot. In the meantime, the pair of movable plates are linked and lifted by the prop member to engage the first protective cover with the second protective cover, and the first comb grooves and the second comb grooves with unequal depths of the first comb and the second comb have a greater extent of bending the hair than the shallower first comb grooves and second comb grooves and a smaller extent of bending the hair than the deeper first comb grooves and second comb grooves. After a cutting at the same cutting surface is performed, layered hair styling of different hair lengths is produced naturally.

In a preferred embodiment of the present invention, the cutting blade has a shape of a convex curve, and the containing slot is in a continuous serrated shape, and the central saw-tooth has a height smaller than or equal to the height of two side saw-teeth, and the cutting blade has a first stop portion disposed on both sides of the cutting blade respectively, and a second stop portion disposed on both sides of the containing slot respectively, such that after the first stop portion and the second stop portion abut with each other to define a sealing and prevent the hair from sliding out by forces. In addition, the first elastic plate has an end coupled to the first knife, and the other end inwardly bent and extended to form a first prop surface, and the second elastic plate has an end coupled to the second knife, and the other end inwardly bent and extended to form a second prop surface, and the first prop surface and the second prop surface abut against each other, and the resilience of the first elastic plate and the second elastic plate is provided for maintaining the first knife and the second knife spread open with respect to each other. In addition, the first limiting hole and the second limiting hole are curved, and the first limiting holes and the second limiting holes have opposite curvature. Each movable plate is in an arc shape, and the limiting plate and the assembling portion are extended to two sides of each movable plate respectively.

In a preferred embodiment, the first protective cover and the second protective cover are integrally formed and manufactured by plastic injection molding, and the first protective cover has a ring disposed at a top side of the first protective cover for passing a finger for the operation of the hair trimming device.

In a preferred embodiment, the first combs and the second combs are disposed alternately and equidistantly with one another, when the first comb of the first protective cover and the second comb of the second protective cover come with plural quantity. In a clamping process, the hair can be bent for several times to enhance the layered hair styling.

DETAILED DESCRIPTION OF THE PREFERRED EMBODIMENTS

The technical content of the present invention will become apparent with the detailed description of preferred embodiments and the illustration of related drawings as follows.

Figure 1A:
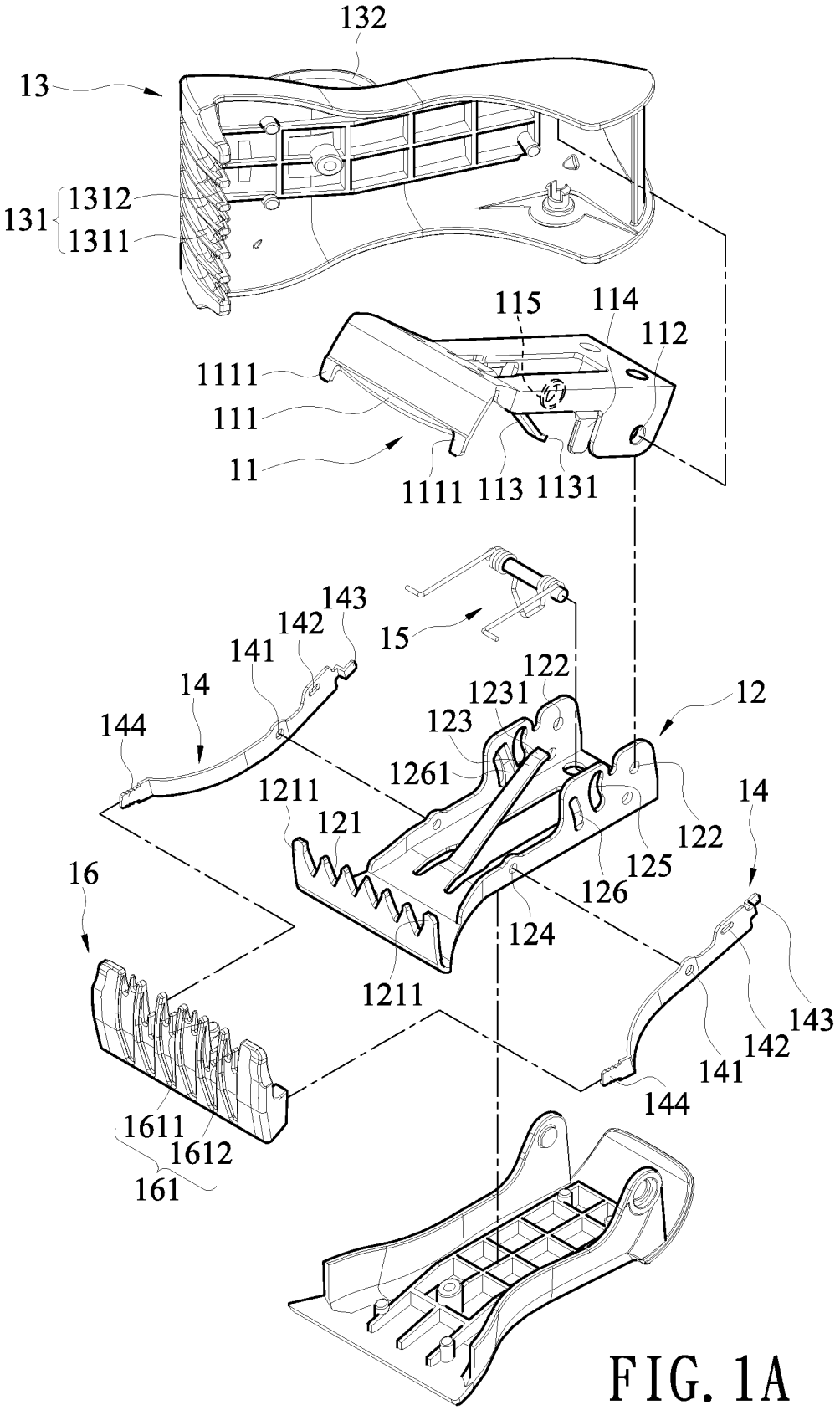
FIG. 1A is an exploded view of a preferred embodiment of the present invention.
Figure 1B:
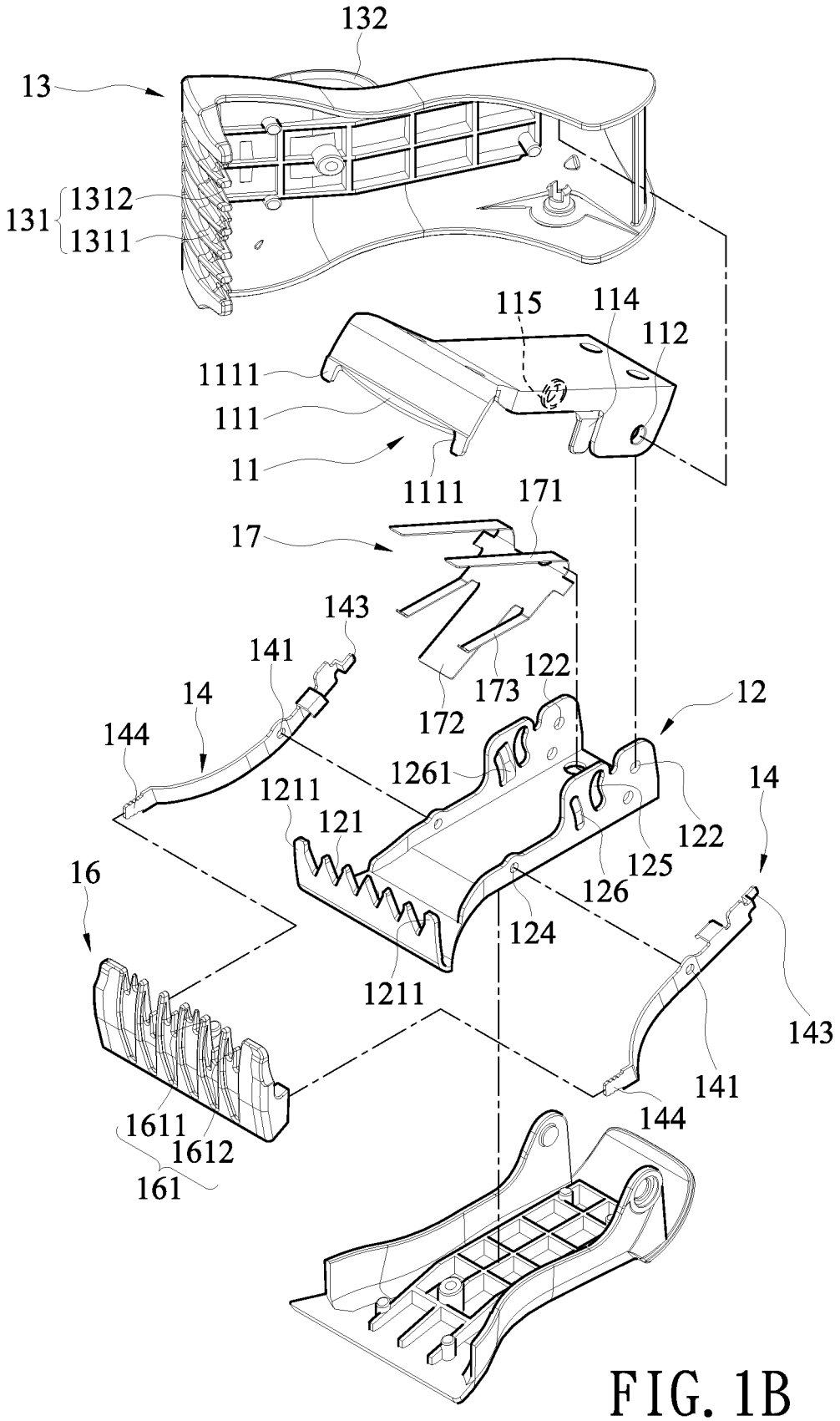
FIG. 1B is an exploded view of another implementation mode of a preferred embodiment of the present invention.
Figure 2:
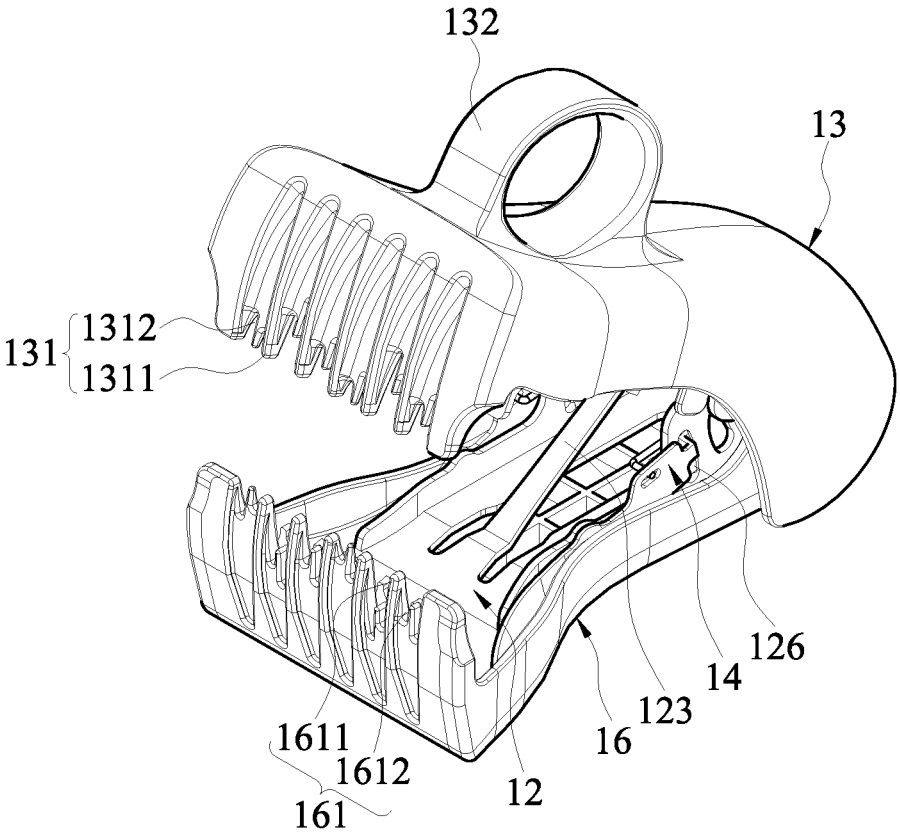
FIG. 2 is a perspective view of a preferred embodiment of the present invention.

With reference to FIGS. 1A, 1B and 2 for exploded views and a perspective view of a preferred embodiment of the present invention respectively, the hair trimming device 1 comprises a first knife 11, a second knife 12, a first protective cover 13, a pair of movable plates 14, an elastic element 15 and a second protective cover 16, for clamping and fixing a amount of hair 2 and cutting the hair 2.

Wherein, the first knife 11 is manufactured by punching and bending a metal, and the first knife 11 has a cutting blade 111 disposed at an end of the first knife 11; the cutting blade 111 is in a shape of a convex curve; the cutting blade 111 has a first stop portion 1111 disposed on both sides of the cutting blade 111 respectively; and a first pivoting portion 112 is disposed at an another end of the first knife 11 respectively. The first knife 11 further has a prop member 114 and a limit member 115 disposed on both sidewalls of the first knife 11 respectively, and the prop member 114 is protruded outwardly from a plane of the sidewall, and the limit member 115 is adjacent to a side of the first pivoting portion 112.

Similarly, the second knife 12 is manufactured by punching and bending a metal, and the second knife 12 has a containing slot 121 formed at an end of the second knife 12 and corresponding to the cutting blade 111. As shown in the figure, the containing slot 121 is in a continuous serrated shape, and the central saw-tooth has a height smaller than or equal to the height of two side saw-teeth, and a second stop portion 1211 is disposed respectively on both sides of the containing slot 121. The first stop portion 1111 and the second stop portion 1211 are abutted against each other to seal the first stop portion 1111 and the second stop portion 1211 to prevent the hair from sliding out by forces. The hair is pushed by the cutting blade 111 and uniformly spread into each saw-tooth. In addition, an another end of the second knife 12 has a second pivoting portion 122 corresponding to the first pivoting portion 112, and the second knife 12 and the first knife 11 are pivotally coupled into a whole and keeping the first and second knifes at an elastically open position under normal condition. In addition, the second knife 12 has a third pivoting portion 124, a first limiting hole 125 and a second limiting hole 126 disposed on both sidewalls of the second knife 12, and the first limiting hole 125 is movably contained in the limit member 115 and disposed at a position corresponding to the limit member 115, and a protrusion 1261 is formed on a side of the second limiting hole 126. Further, the first limiting hole 125 and the second limiting hole 126 are in a curve shape, and the first limiting holes and the second limiting holes have opposite curvatures.

In addition, the first knife 11 and the second knife 12 of the present invention can be elastically spread open in the following two ways. The first way is that the first knife 11 and the second knife 112 are manufactured into integrally formed elastic plates. As shown in FIG. 1A, the first knife 11 has a first elastic plate 113 installed at the middle of the first knife 11, and an end of the first elastic plate 113 is coupled to the first knife 11, and the other end of the first elastic plate 113 is inwardly bent and extended to form a first prop surface 1131. The second knife 12 has a second elastic plate 123 installed at the middle of the second knife 12, and an end of the second elastic plate 123 is coupled to the second knife 12, and the other end of the second elastic plate 123 is inwardly bent and extended to form a second prop surface 1231. After the assembling process takes place, the first prop surface 1131 and the second prop surface 1231 are abutted against each other, and the resilience of the first elastic plate 113 and the second elastic plate 123 is provided to normally maintain the first knife 11 and the second knife 12 at an elastically open position with respect to each other. The second way is that an integrally formed elastic plate is used. As shown in FIG. 1B, the elastic element 15 is manufactured in form of an bent elastic plate 17 and installed between the first knife 11 and the second knife 12, and both ends of the bent elastic plate 17 have a first prop portion 171, a second prop portion 172 and a third prop portion 173 respectively, and the first prop portion 171 and the second prop portion 172 abut against inner sides of the first knife 11 and the second knife 12 respectively, and the resilience of the bent elastic plate 17 is provided for normally maintaining the first knife 11 and the second knife 121 at an elastically open position with respect to each other, and the third prop portion 173 abuts against a side of the two movable plates 14 to provide the required resilience. Either one of the aforementioned ways can be used to achieve the same effect. After forces are applied to engage the first knife 11 and the second knife 12, the resilience of the spring 116 can resume the first knife 11 and the second knife 12 to their original open state.

The first protective cover 13 is integrally formed and manufactured by plastic injection molding and used for covering the exterior of the first knife 11. The first protective cover 13 has at least one first comb 131 disposed at a front end of the first protective cover 13 and corresponding to the cutting blade 111. The first comb 131 has a plurality of first comb teeth 1311 formed at an edge of the first comb 131. A plurality of first comb grooves 1312 of different depths are formed between any two adjacent first comb teeth 1311 respectively. It is noteworthy that the quantity of the first combs 131 can be plural to achieve the effect of bending the hair for several times. The first combs 131 can be arranged equidistantly or non-equidistantly, but they are preferably arranged equidistantly. In addition, the first protective cover 13 has a ring 132 installed at the top of the first protective cover 13 and provided for passing a user's finger for the operation of the hair trimming device.

The pair of movable plates 14 are manufactured by stamping and bending a metal, and each movable plate 14 has a fourth pivoting portion 141 disposed at the middle of the movable plate 13 and corresponding to the third pivoting portion 124, and the pair of movable plates 14 are movably and pivotally coupled into the pair of third pivoting portions 124 respectively. Each movable plate 14 has a through hole 142 and a limiting plate 143 disposed at an end of the movable plate 14 and an assembling portion 144 disposed at an another end of the movable plate 14. Wherein the pair of prop members 114 of the first knife 11 are abutted against the upper edges of the pair of movable plates 14 respectively to define a linkage. In addition, each movable plate 14 is in a curved shape, and the limiting plate 143 and the assembling portion 144 are extended and disposed on both sides of each movable plate 14 respectively.

The elastic element 15 is installed between the first knife 11 and the second knife 12, and an end of the elastic element 15 is passed and installed into the pair of through holes 142 of the pair of movable plates 14, and an another end of the elastic element 15 is fixed onto the second knife 12, and the resilience of the elastic element 15 is provided for propping the pair of movable plates 14 upward.

Similarly, the second protective cover 16 is integrally formed and manufactured by plastic injection molding, and coupled between the assembling portions 144 of the pair of movable plates 14, and the second protective cover 16 has at least one second comb 161 corresponding to the containing slot 121, a plurality of second comb teeth 1611 formed at an edge of the second comb 161, and a plurality of second comb grooves 1612 with different depths formed between the second comb teeth 1611 respectively. It is noteworthy that the quantity of second combs 161 can be plural and must be corresponding to the quantity of first combs 131 for bending the hair for several times. The second combs 161 can be arranged equidistantly or non-equidistantly with one another, but the invention preferably adopts the equidistant arrangement, and the first combs 131 and the second combs 161 are arranged alternately with each other.

Figure 3:
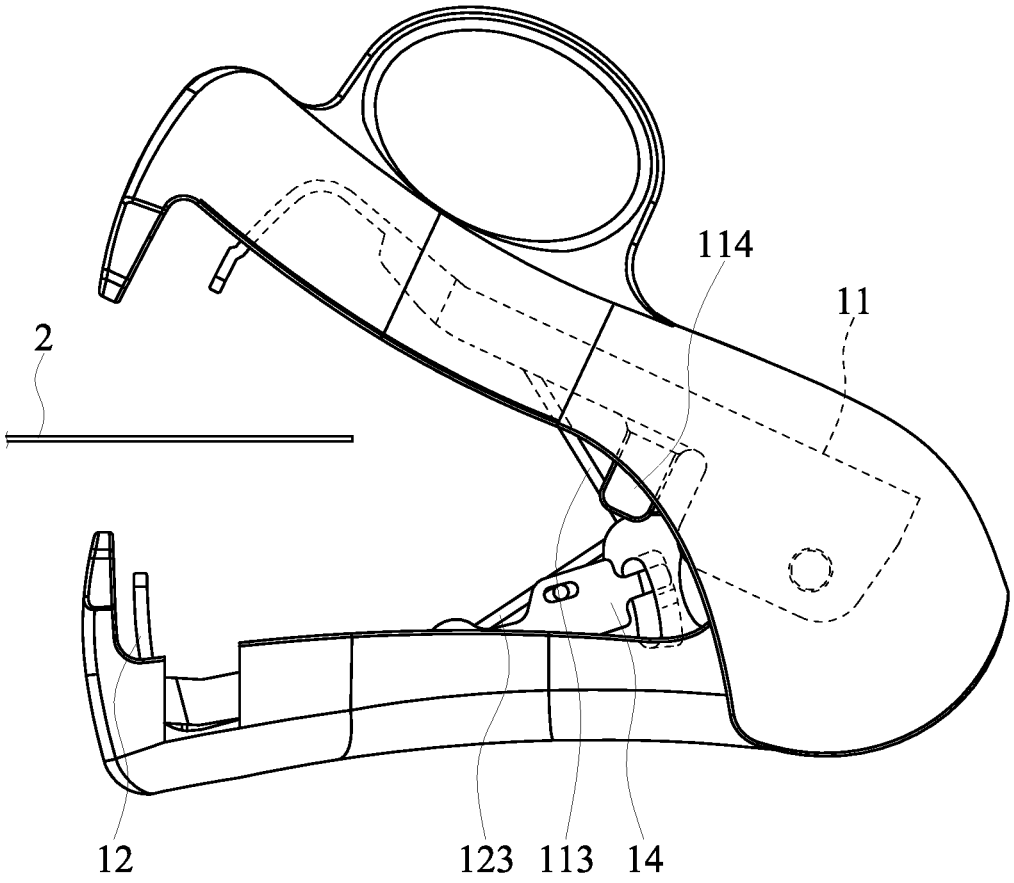
FIG. 3 is a first schematic view of an operation of a preferred embodiment of the present invention.
Figure 4:
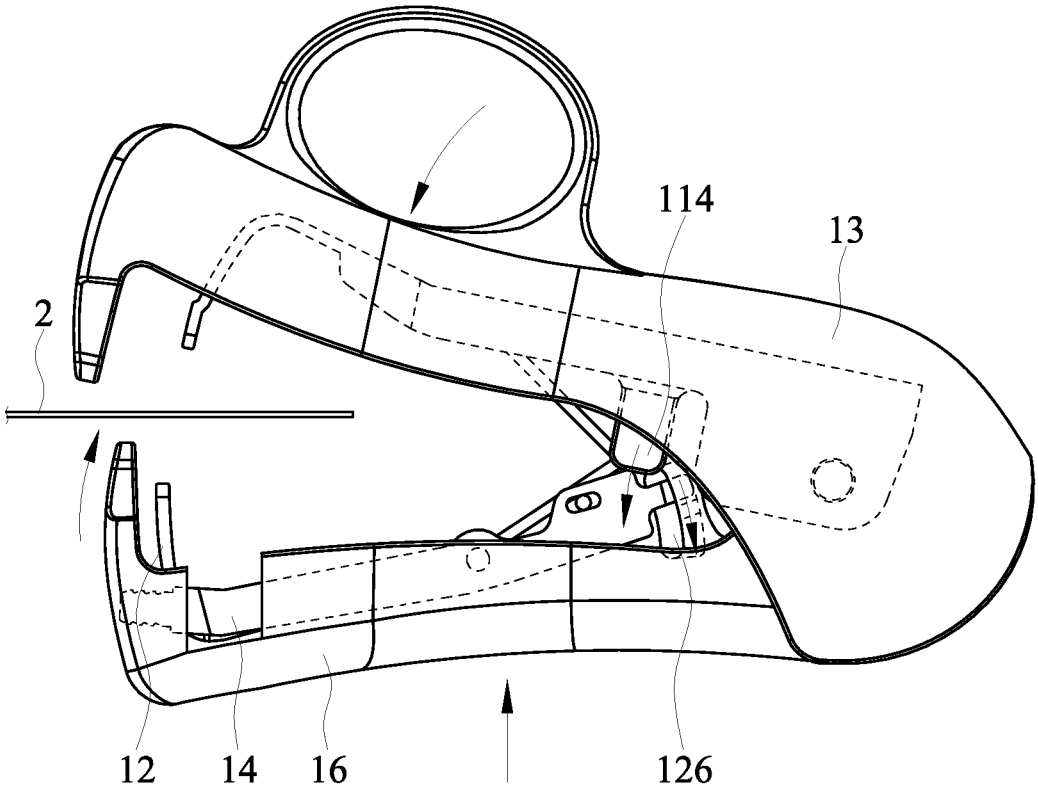
FIG. 4 is a second schematic view of an operation of a preferred embodiment of the present invention.
Figure 5:
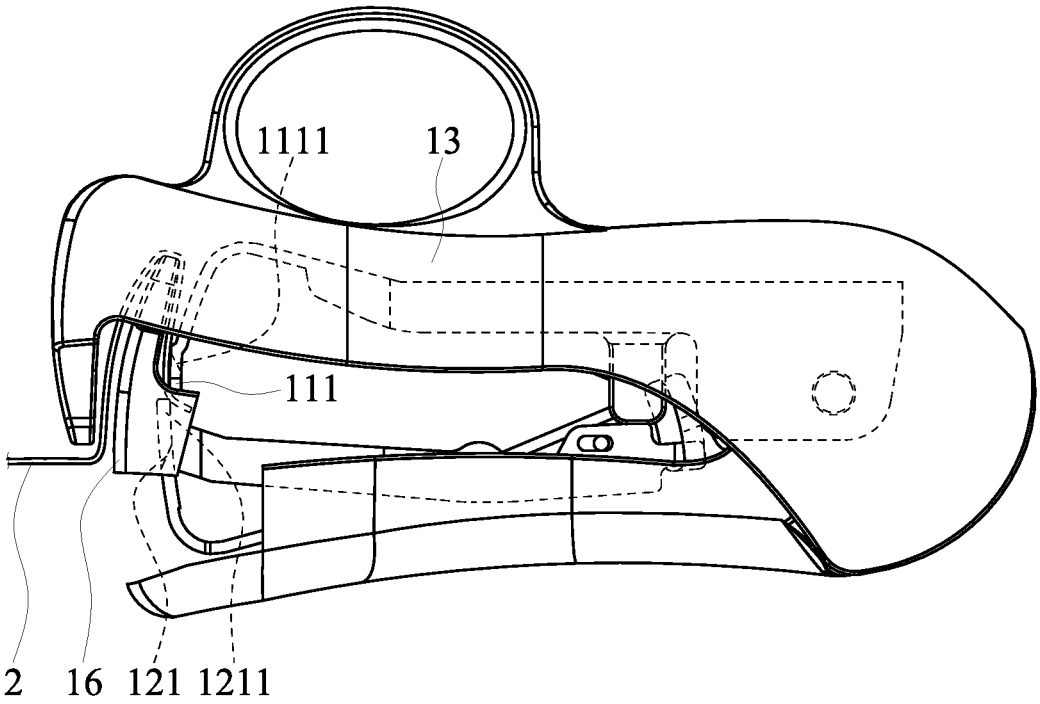
FIG. 5 is a third schematic view of an operation of a preferred embodiment of the present invention.
Figure 6:
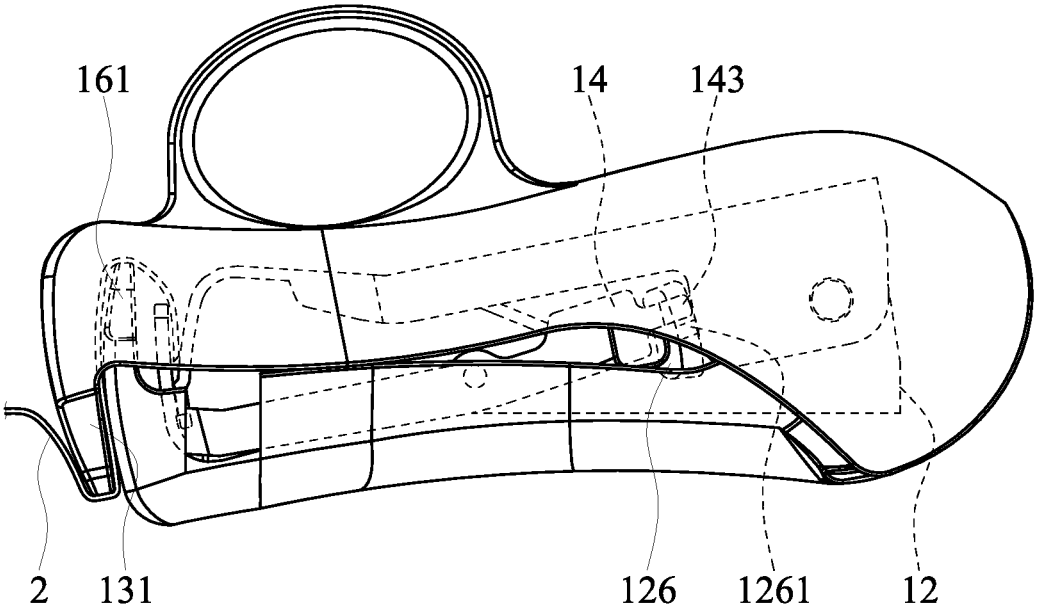
FIG. 6 is a fourth schematic view of an operation of a preferred embodiment of the present invention.

With reference to FIGS. 3 to 6 for schematic views of movements in an operation of a preferred embodiment of the present invention together with FIG. 1, FIG. 3 shows the hair trimming device 1 of the present invention being used; wherein, the first knife 11 and the second knife 12 are spread open by the resilience of the first elastic plate 113 and the second elastic plate 123 to allow the hair 2 to be placed between the first knife 11 and the second knife 12, and the pair of prop members 114 are maintained on a moving path of the pair of corresponding movable plates 14. In FIG. 4, the first protective cover 13 and the second knife 12 are operated to produce a closing movement with respect to each other, and the pair of prop members 114 are linked to press downwardly at an end of the pair of movable plates 14, and the limiting plate 143 of each movable plate 14 is moved downwardly into the second limiting hole 126, and the pivoting position is used as a fulcrum to lift the other end of the pair of movable plates 14 with respect to an end of the second protective cover 1. In FIG. 5, the second protective cover 16 and the first protective cover 13 are abutted against each other, such that the hair 2 is bent, clamped and fixed therein, and the first stop portions 1111 and the second stop portions 1121 are also abutted against each other. The cutting blade 111 pushes and squeezes the hair 2 to spread uniformly into the containing slot 121. In FIG. 6, forces are applied to the first protective cover 13 and the second knife 12 to continue the cutting movement, and the pair of limiting plates 143 of the pair of movable plates 14 are moved inside the second limiting hole 126 and at positions corresponding to the protrusions 1261, and the limiting plates will rise along the protrusions 1261, so that the movable plates 14 situated outside are moved inwardly towards both sidewalls of the second knife 12 to form a height difference between the prop members 114, so that the pair of prop members 114 can no longer continue propping the upper edges of the pair of movable plates 14; and thus, they are moved alternately. In the meantime, the cutting blade 111 and the containing slot 121 are aligned precisely with each other to cut the hair 2. The unequal depths in the first comb grooves 1312 of the first comb 131 and the second comb grooves 1612 of the second comb 161 causes hair in the shallower first comb grooves 1312 and second comb grooves 1612 to bend less than the hair in the deeper first comb grooves 1312 and second comb grooves 1612, so that the cut hair will have a layering effect of the hairs with different lengths.

Figure 7:
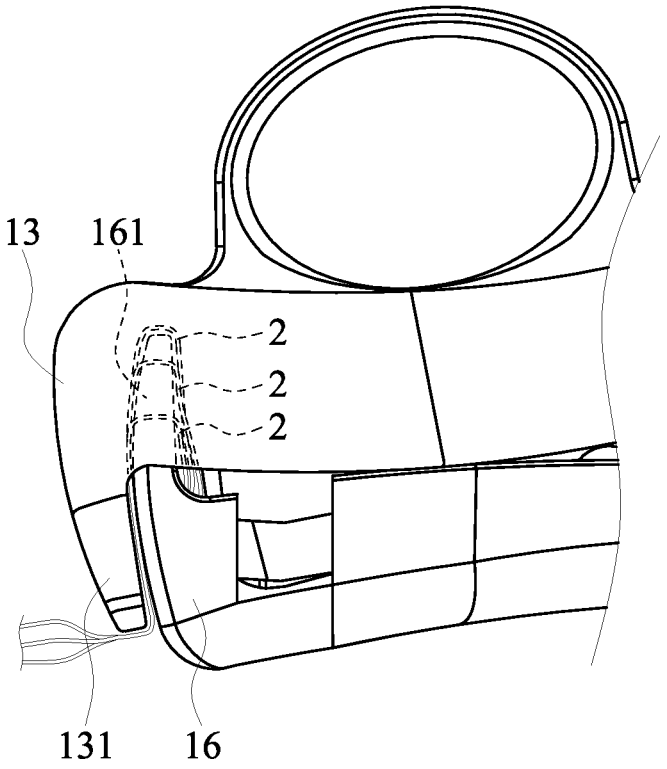
FIG. 7 is a schematic view of bent hair when a first protective cover and a second protective cover are one-step protective covers.
Figure 8:
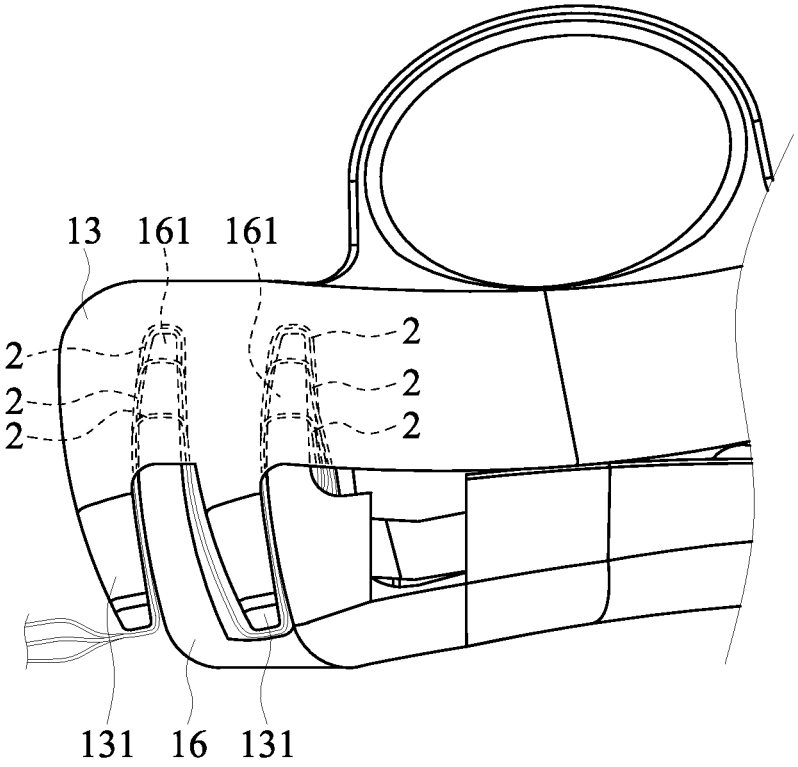
FIG. 8 is a schematic view of bent hair when a first protective cover and a second protective cover are two-step protective covers.
Figure 9:
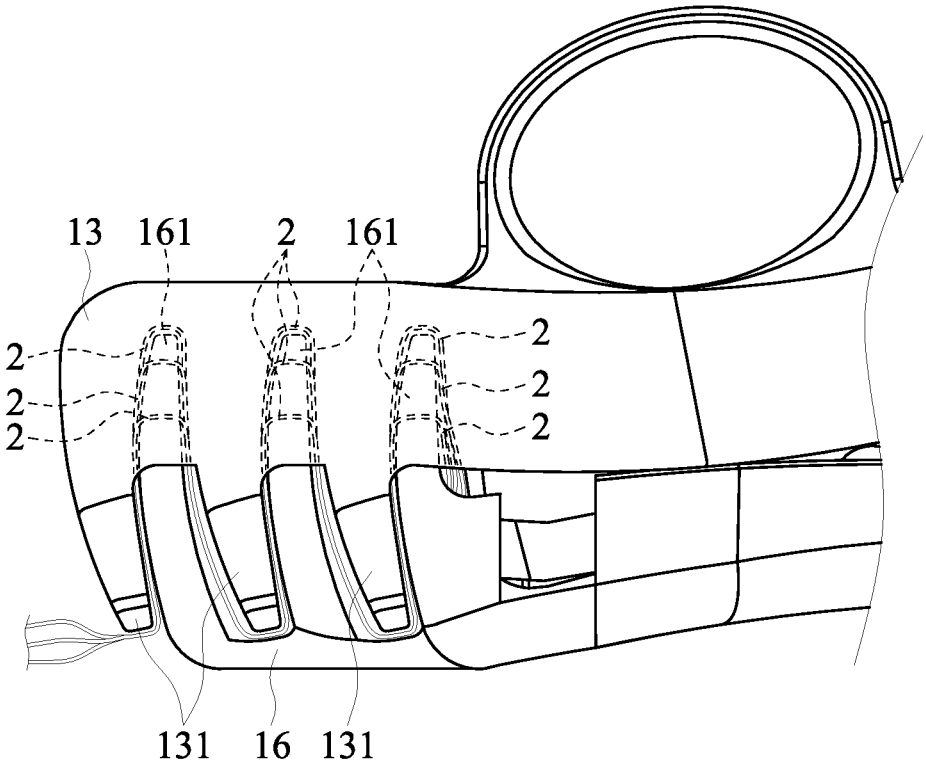
FIG. 9 is a schematic view of bent hair when a first protective cover and a second protective cover are three-step protective covers.
Figure 10:
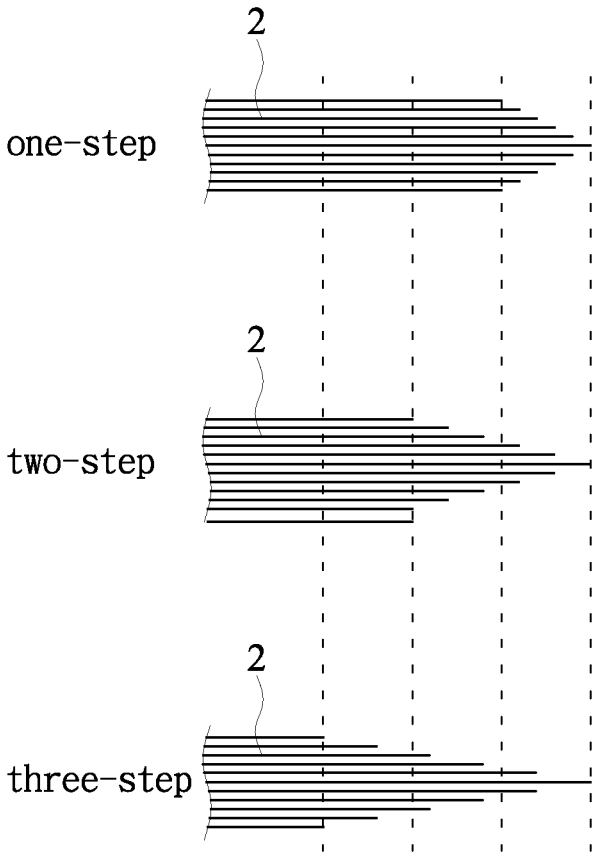
FIG. 10 is a schematic view of comparing the length of hairs that are cut by first protective covers and second protective covers having different numbers of steps.

With reference to FIGS. 7 to 10 for schematic views of the bent hairs during the utilization of the first protective covers and the second protective covers with different numbers of steps in a preferred embodiment of the present invention respectively, and a schematic view of a comparison between the length of hairs that are cut by the first protective covers and second protective covers having different steps. Referring to FIG. 1A, with different quantities of the first combs 131 and second combs 161 of the first protective cover 13 and the second protective cover 16, the lengths of the cut hairs 2 will be different. FIG. 7 illustrates the embodiments for the one-step first comb 131 and the one-step second comb 161. As shown in the figure, the hair 2 is bent once, during which the amount of bending for hair varies with the depth of the first comb grooves 1312 and the second comb grooves 1612, so that the cut hair will have layered hair styling of different lengths of hair. FIG. 8 illustrates the embodiment of the two-step first comb 131 and the two-step second comb 161. There are two first combs 13 and two second combs 16, so that the hair 2 will be bent twice continuously by the first comb grooves 1312 and the second comb grooves 1612 of different depths. The amount of bending of hair 2 is greater. Compared with the one-step combs, the two-step combs can have a significantly difference of the lengths of the cut hair. FIG. 9 is the embodiment for the third-step first combs 13 and the third-step second combs 16. The hair 2 is bent three times accordingly, and the amount of bending for the hair 2 is even greater than that of the two-step combs. From FIG. 10, it is easy to see that the more the number of steps, the greater is the difference of the lengths of the cut hairs. In other words, the three-step combs create better layered hair styling than that of the two-step combs, which in turn create better layered hair styling than that of the one-step combs.

What is claimed is:

1. A hair trimming device, comprising:

a first knife, having a cutting blade disposed at an end of the first knife, a first pivoting portion disposed at an another end of the first knife, and a prop member and a limit member disposed on both sidewalls of the first knife respectively, and the prop member being protruded outwardly from a plane of the sidewall, and the limit member being adjacent to a side of the first pivoting portion;

a second knife, having a containing slot formed at an end of the second knife and corresponding to the cutting blade, a second pivoting portion disposed at an another end of the second knife and corresponding to the first pivoting portion for pivotally coupling the second knife and the first knife as a whole, and keeping the first and second knifes at an elastically open position under normal condition, and a third pivoting portion, a first limiting hole and a second limiting hole disposed on both sidewalls of the second knife respectively, and the first limiting hole being disposed at a position corresponding to the limit member and movably contained in the limit member, and a protrusion being formed on a side of the second limiting hole;

a first protective cover, covered onto the exterior of the first knife, and having at least one first comb corresponding to the cutting blade, a plurality of first comb teeth formed at an edge of the first comb, and a plurality of first comb grooves with different depths being formed between two adjacent first comb teeth respectively;

a pair of movable plates, each having a fourth pivoting portion disposed at the center of the movable plate and corresponding to the third pivoting portion, and the pair of movable plates being respectively, movably and pivotally coupled to the pair of third pivoting portions, and a through hole and a limiting plate being disposed at an end of each movable plate, and an assembling portion being disposed at an another end of each movable plate, wherein the prop members of the first knife propping an upper edge of the pair of the corresponding movable plates to form a linkage;

an elastic element, installed between the first knife and the second knife, and having an end passing into the pair of through holes of the pair of movable plates, and an another end fixed onto the second knife, and the resilience of the elastic element pushing the pair of movable plates upward; and a second protective cover, coupled between the assembling portions of the pair of movable plates, and having at least one second comb corresponding to the containing slot, a plurality of second comb teeth formed at an edge of the second comb, and a plurality of second comb grooves with different depths being formed between two adjacent second comb teeth respectively.

2. The hair trimming device according to claim 1, wherein the cutting blade has a shape of a convex curve, and the containing slot is in a continuous serrated shape, and the central saw-tooth of the containing slot has a height smaller than or equal to the height of the saw-teeth on the two sides of the containing slot.

3. The hair trimming device according to claim 2, wherein the cutting blade has a first stop portion disposed on both sides of the cutting blade respectively, and a second stop portion is disposed on both sides of the containing slot respectively, such that after the first stop portion and the second stop portion abut with each other to define a sealing and prevent the hair from sliding out by forces.

4. The hair trimming device according to claim 3, wherein the hair trimming device further comprises a first elastic plate and a second elastic plate, the first elastic plate has an end coupled to the first knife, and an another end inwardly bent and extended to form a first prop surface, and the second elastic plate has an end coupled to the second knife, and an another end inwardly bent and extended to form a second prop surface, and the first prop surface and the second prop surface abut against each other, and the resilience of the first elastic plate and the second elastic plate is provided for maintaining the first knife and the second knife spread open with respect to each other.

5. The hair trimming device according to claim 3, wherein the first limiting holes and the second limiting holes are curve shaped, and the first limiting holes and the second limiting holes have opposite curvature.

6. The hair trimming device according to claim 3, wherein each movable plate is in a curve shape, and the limiting plate of each movable plate and the assembling portion of each movable plate are extended to two sides of each movable plate respectively.

7. The hair trimming device according to claim 3, wherein the first protective cover and the second protective cover are integrally formed and manufactured by plastic injection molding.

8. The hair trimming device according to claim 7, wherein the first protective cover has a ring disposed at a top side of the first protective cover for passing a finger for the operation of the hair trimming device.

9. The hair trimming device according to claim 8, wherein when the first comb of the first protective cover and the second comb of the second protective cover come with plural quantity, the first combs and the second combs are disposed alternately and equidistantly with one another.

10. The hair trimming device according to claim 1, wherein when the first comb of the first protective cover and the second comb of the second protective cover come with plural quantity, the first combs and the second combs are disposed alternately and equidistantly with one another.

* * * * *